US012173923B2

(12) United States Patent
Varma et al.

(10) Patent No.: US 12,173,923 B2
(45) Date of Patent: Dec. 24, 2024

(54) BLADELESS COOLING FAN

(71) Applicant: Airtek International Corporation Limited, Kwun Tong (CN)

(72) Inventors: Sanjay Varma, Zhongshan (CN); Anand Vyas, Zhongshan (CN); Huoxi Zhou, Zhongshan (CN); Yi Pu, Zhongshan (CN); Hongbo Shen, Zhongshan (CN)

(73) Assignee: Airtek International Corporation Limited, Hong Kong (CN)

( * ) Notice: Subject to any disclaimer, the term of this patent is extended or adjusted under 35 U.S.C. 154(b) by 442 days.

(21) Appl. No.: 17/594,886

(22) PCT Filed: Mar. 18, 2021

(86) PCT No.: PCT/CN2021/081431
§ 371 (c)(1),
(2) Date: Nov. 2, 2021

(87) PCT Pub. No.: WO2021/197080
PCT Pub. Date: Oct. 7, 2021

(65) Prior Publication Data

US 2022/0228759 A1 Jul. 21, 2022

(30) Foreign Application Priority Data

Apr. 3, 2020 (CN) ..... 202010258843.7
Mar. 9, 2021 (CN) ..... 202110258257.7

(51) Int. Cl.
*F04D 25/08* (2006.01)
*F24F 5/00* (2006.01)
(Continued)

(52) U.S. Cl.
CPC ..... *F24F 5/0035* (2013.01); *F24F 11/89* (2018.01); *F04D 25/08* (2013.01); *F04D 29/541* (2013.01);
(Continued)

(58) Field of Classification Search
CPC ..... F04D 25/08; F04D 29/54; F04D 29/541; F04D 29/545; F24F 2013/205; F04F 5/16
See application file for complete search history.

(56) References Cited

U.S. PATENT DOCUMENTS

2010/0226797 A1* 9/2010 Fitton ..... F24F 7/06 417/313
2017/0045060 A1* 2/2017 He ..... F04D 29/541
2019/0170162 A1* 6/2019 Jennings ..... F04D 19/002

FOREIGN PATENT DOCUMENTS

CN 201027678 Y * 2/2008
CN 201407198 Y * 2/2010
(Continued)

OTHER PUBLICATIONS

International Search Report of PCT/CN2021/081431.

*Primary Examiner* — David E Sosnowski
*Assistant Examiner* — Arthur Paul Golik
(74) *Attorney, Agent, or Firm* — Wang Law Firm, Inc.

(57) ABSTRACT

The present invention discloses a bladeless cooling fan, which is used to solve the problem of poor use experience of the fan in the prior art. The bladeless cooling fan comprises: a fan body, comprising an air inlet; a water cooling component, which is provided together with the air inlet, wherein the water cooling component cools the air that enters the fan body via the air inlet; a wind wheel component, which is accommodated in the fan body and arranged to generate air flow; an air outlet component, which is installed on the fan body, wherein the air outlet component
(Continued)

is arranged to receive the air flow from the fan body and guide the air flow to be ejected to the set direction.

14 Claims, 16 Drawing Sheets

(51) Int. Cl.
*F24F 11/89* (2018.01)
*F04D 29/54* (2006.01)
*F24F 13/20* (2006.01)

(52) U.S. Cl.
CPC ..... *F04D 29/545* (2013.01); *F24F 2013/205* (2013.01)

(56) References Cited

FOREIGN PATENT DOCUMENTS

| | | | | | |
|---|---|---|---|---|---|
| CN | 202734057 | U | | 2/2013 | |
| CN | 110805569 | A | | 10/2014 | |
| CN | 203869157 | U | | 10/2014 | |
| CN | 205744370 | U | | 11/2016 | |
| CN | 206190604 | U | | 5/2017 | |
| CN | 206555160 | U | * | 10/2017 | |
| CN | 208332545 | U | | 1/2019 | |
| CN | 208606311 | U | | 3/2019 | |
| CN | 110107974 | A | | 8/2019 | |
| CN | 110529949 | A | * | 12/2019 | |
| CN | 110685941 | A | * | 1/2020 | ..... B01D 46/2411 |
| CN | 111322701 | A | * | 6/2020 | ..... F24F 5/0035 |
| CN | 211925999 | U | | 11/2020 | |
| GB | 2502106 | A | * | 11/2013 | ..... F04D 25/08 |
| KR | 20170027800 | A | | 3/2017 | |

* cited by examiner

BLADELESS COOLING FAN

TECHNICAL FIELD

The present invention belongs to the technical field of household appliances, and in particular, relates to a bladeless cooling fan.

BACKGROUND

Traditional household fans usually comprise a set of blades or fins installed to rotate about an axis, and a driving device that rotates the blades to generate air flow. The movement and circulation of the air flow form an "air cooling" effect. When the heat is dissipated by convection and evaporation, the user feels the cooling effect.

The disadvantage of this arrangement is that in order to disturb the surrounding air and form a larger range of air flow, it is often necessary to provide a larger-sized rotating blade, which occupies more operating space; at the same time, the manner of dissipating heat only by convection and evaporation does not directly give the user the air flow at a lower temperature, and especially in the case of low ambient humidity, a satisfactory using effect cannot be obtained.

SUMMARY

The purpose of the present application is to provide a bladeless cooling fan to solve the problem of poor use experience of the household fan in the prior art.

In order to achieve the above purpose, the technical solution provided by an embodiment of the present application is as follows:

a bladeless cooling fan, comprising:

a fan body, comprising an air inlet;

a water cooling component, which is provided together with the air inlet, wherein the water cooling component cools the air that enters the fan body via the air inlet;

a wind wheel component, which is accommodated in the fan body and arranged to generate air flow;

an air outlet component, which is installed on the fan body, wherein the air outlet component is arranged to receive the air flow from the fan body and guide the air flow to be ejected to the set direction.

In an embodiment, the air inlet is provided around the fan body; preferably, the air inlet comprises an array of holes formed on the fan body; preferably, the cross-section of the fan body is rectangular, and the air inlet is provided on the side wall on the periphery of the fan body.

By surrounding the air intake around the air inlet, a greater amount of air intake can be provided.

In an embodiment, the water cooling component comprises four sheets of wet curtain paper surrounding each other to form a square tubular cooling cavity, the air entering the fan body through the air inlet reaches the cooling cavity through the wet curtain paper, and the wind wheel component generates air flow by driving the air in the cooling cavity; preferably, the water cooling component further comprises a water tank, a water pump, and upper and lower water receiving trays cooperated with the wet curtain paper, the water pump is used to lift the water in the water tank to the upper water receiving tray, the upper water receiving tray is configured to transport water to the wet curtain paper, and the lower water receiving tray is configured to transport water recycled by the wet curtain paper to the water tank.

The surrounding layout of the four sheets of wet curtain paper can provide timely and efficient cooling effect for the air entering through the air inlet, so that the air flow finally ejected from the air outlet component has a lower initial temperature than the use environment, bringing a more direct cooling effect.

In an embodiment, the wind wheel component comprises a diagonal flow wind wheel.

The diagonal flow wind wheel has the advantages of a centrifugal wind wheel and an axial flow wind wheel, and can provide a higher level in three aspects of air volume, air pressure and air speed.

In an embodiment, the wind wheel component further comprises a first volute and a second volute cooperated with each other, the first volute is cooperated with the second volute to form a wind wheel cavity accommodating the diagonal flow wind wheel, the first volute is provided with a first volute opening through which air enters, and the second volute is provided with a second volute opening through which air flow generated by the diagonal flow wind wheel exits.

In an embodiment, the wind wheel component further comprises a third volute cooperated with the second volute to form a deflector cavity, the third volute is provided with a third volute opening through which air flow exits, a deflector cover is provided in the deflector cavity, and the deflector cover is used to guide the air flow flowing into the deflector cavity through the second volute opening to the third volute opening.

In an embodiment, the third volute is symmetrically provided with two of the third volute openings, the deflector cover has a gradually decreasing cross-sectional area in the direction in which the deflector cover extends from the second volute to the third volute, a deflector fin cooperated with the inner wall of the third volute is formed on the deflector cover, and the deflector fin divides the deflector cavity into two parts corresponding to the two third volute openings.

In an embodiment, the air outlet component comprises two air inlets corresponding to the two third volute openings and an air outlet through which the air flow is ejected, wherein the second volute opening has an area≤the sum of the areas of the third volute openings=the sum of the areas of the air inlets≤the area of the air outlet. In this way, a high air pressure and a high air volume of the air flow ejected from the air outlet component can be ensured.

In an embodiment, the second volute opening is ring-shaped, a plurality of first deflectors are arranged at intervals radially in the second volute opening, and the first deflector extends in the direction away from the first volute, which is substantially the same as the direction of air flow through the second volute opening.

In an embodiment, a plurality of second deflectors respectively corresponding to the plurality of first deflectors are provided on the deflector cover, and the second deflector is parallel to the central axis of the deflector cover.

In an embodiment, the air outlet component comprises an air inlet corresponding to the third volute opening, the third volute further comprises a deflector part provided at the third volute opening, and the deflector part has an outer profile that gradually changes in the direction of the third volute opening toward the direction of the air inlet, so that at least part of the air flow exiting through the third volute opening is guided to the air inlet.

In an embodiment, the deflector part has a substantially gradually increasing cross-sectional area in the direction away from the third volute opening, and on the plane perpendicular to the central axis of the third volute, a part of the outer edge of the projection of the deflector part is located in the projection of the third volute opening. Such an arrangement allows at least part of the air flow exiting through the third volute opening to directly enter the air inlet of the air outlet component without being disturbed by the deflector part, thereby increasing the air volume of the air outlet component.

In an embodiment, the air outlet component comprises an air outlet, an air inlet, and an internal channel that transports air flow from the air inlet to the air outlet; preferably, in the plane direction perpendicular to the direction in which the air flow of the air outlet component is ejected, the air outlet is generally U-shaped.

In an embodiment, the internal channel comprises:

a first channel part, which corresponds to the air inlet to receive the air flow entering from the air inlet;

a second channel part, the end of which defines the air outlet;

a bending channel part, which connects the first channel part and the second channel part; wherein in the plane direction perpendicular to the extending direction of the air outlet, the first channel part and the second channel part are substantially parallel, and the air flow has substantially opposite flow directions in the first channel part and the second channel part.

In an embodiment, in the plane direction perpendicular to the extending direction of the air outlet, the width of the first channel part>the width of the second channel part≥one third of the width of the first channel part to ensure that the air flow in the first channel part can be smoothly ejected from the air outlet at the end of the second channel part.

In an embodiment, in the plane direction perpendicular to the extending direction of the air outlet, the width of the second channel part<the length of the second channel part; preferably, the width of the second channel part is approximately equal to a half of the length of the second channel part.

In an embodiment, a plurality of third deflectors are arranged at intervals in the direction in which the air outlet extends, and the central axis of the hole defined by any two adjacent third deflectors is substantially parallel to the direction in which the air flow of the air outlet component is ejected; preferably, the extending length of the third deflector at least partially adjacent to the air inlet is greater than that of the third deflector remote from the air inlet.

In an embodiment, the third deflector at least partially adjacent to the air inlet has a gradually increasing extending length in the direction away from the air inlet; and/or the third deflector at least partially adjacent to the air inlet is in an arc-shaped sheet shape bent toward the air inlet.

In an embodiment, a heating component and a wind deflector are provided in the internal channel; wherein when the bladeless cooling fan is in a heating state, the heating component is capable of being driven to move from a first channel part to a second channel part, and the wind deflector is capable of being driven to close at least part of the air outlet, so that the air received from the fan body is heated via the heating component and then emitted from the air outlet.

In an embodiment, the air outlet component is connected with a mounting limiting base, the fan body is rotatably connected with an mounting base, and the air outlet component is rotatably connected with the fan body through the matching of the mounting limiting base and the mounting base; wherein a first position sensor is provided on the mounting limiting base, a second position sensor is provided on the mounting base, and the bladeless cooling fan controls the rotation angle of the air outlet component relative to the fan body through the detection results of the first position sensor and the second position sensor.

In an embodiment, an annular mounting cover and an annular driven gear assembled on the mounting cover are fixed on the fan body, a ball bearing component is provided between the mounting cover and the driven gear, and the bladeless cooling fan further comprises a driving gear which is capable of being driven and meshed with the driven gear.

In an embodiment, the mounting limiting base is mechanically connected with the mounting base by screws, and the air outlet component is electrically connected with the fan body by a telescopic connecting wire connected with a quick connector.

Such an arrangement can ensure that the air flow ejected from the air outlet can be ejected in the set direction as concentrated as possible, reducing e the diffusion of the air flow in an unintended direction, and improving the cooling effect of the bladeless cooling fan on the target user. At the same time, the air flow can be more easily trapped when the initial air flow speed in the air inlet component is faster, so that the air outlet adjacent to the air inlet can also have an ideal air outlet effect.

BRIEF DESCRIPTION OF THE DRAWINGS

In order to explain the technical solutions in the embodiments of the present application or the prior art more clearly, the drawings used in the description of the embodiments or the prior art will be briefly introduced below. Obviously, the drawings in the following description are only some embodiments recorded in the present application. For those skilled in the art, other drawings can be obtained according to these drawings without paying creative labor.

DESCRIPTION OF THE EMBODIMENTS

Figure 1:
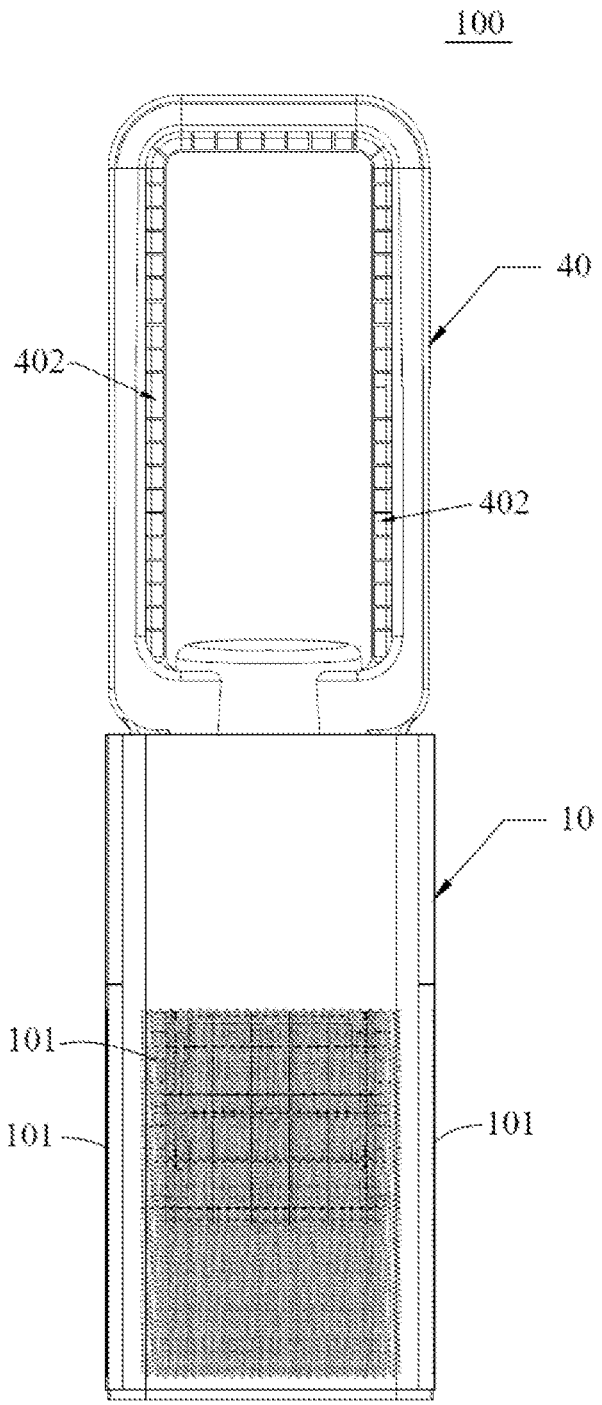
FIG. 1 is an overall schematic diagram of a bladeless cooling fan according to an embodiment of the present application.

The present invention will be described in detail below with reference to the embodiments shown in the drawings. However, these embodiments do not limit the present invention. Changes in structures, methods, or functions made by those skilled in the art based on these embodiments are all included in the protection scope of the present invention.

Figure 2:
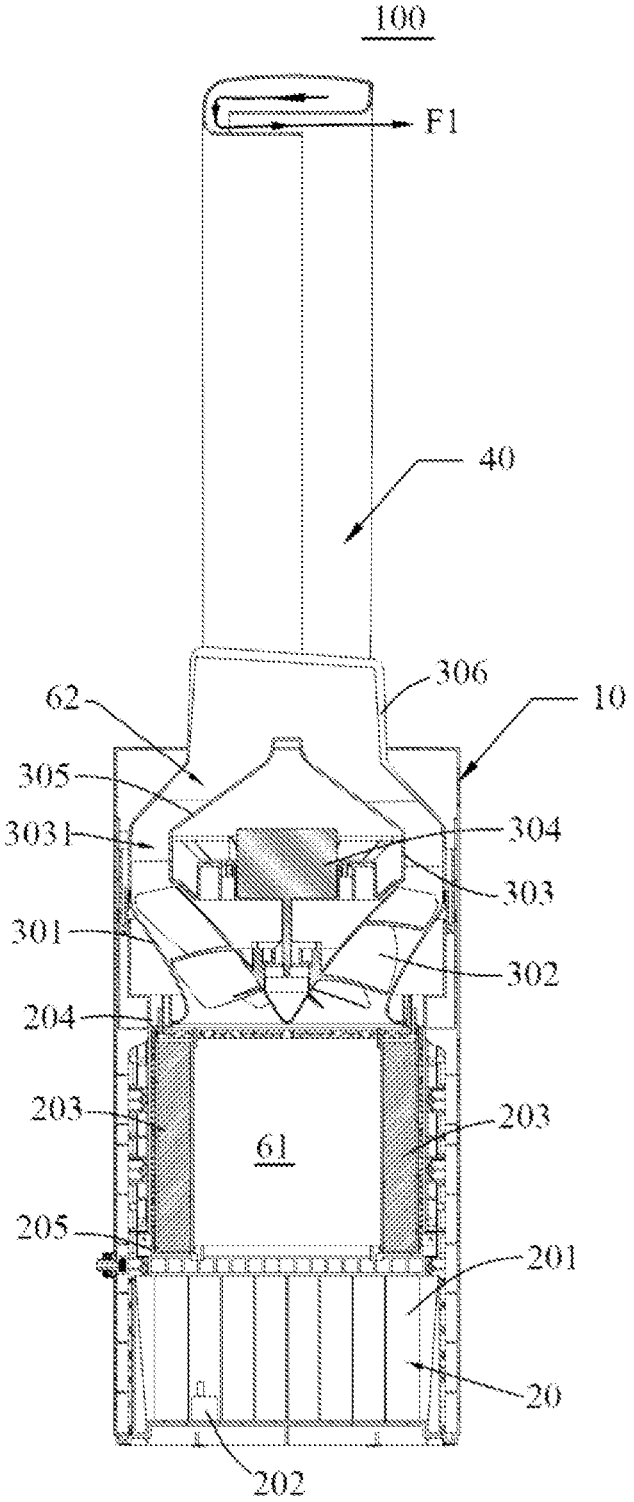
FIG. 2 is a cross-sectional diagram of a bladeless cooling fan according to an embodiment of the present application.

Referring to FIGS. 1 and 2, an embodiment of the bladeless cooling fan 100 of the present application will be described. In this embodiment, the bladeless cooling fan 100 comprises a fan body 10, a water cooling component 20, a wind wheel component 30 and an air outlet component 40.

Figure 3:
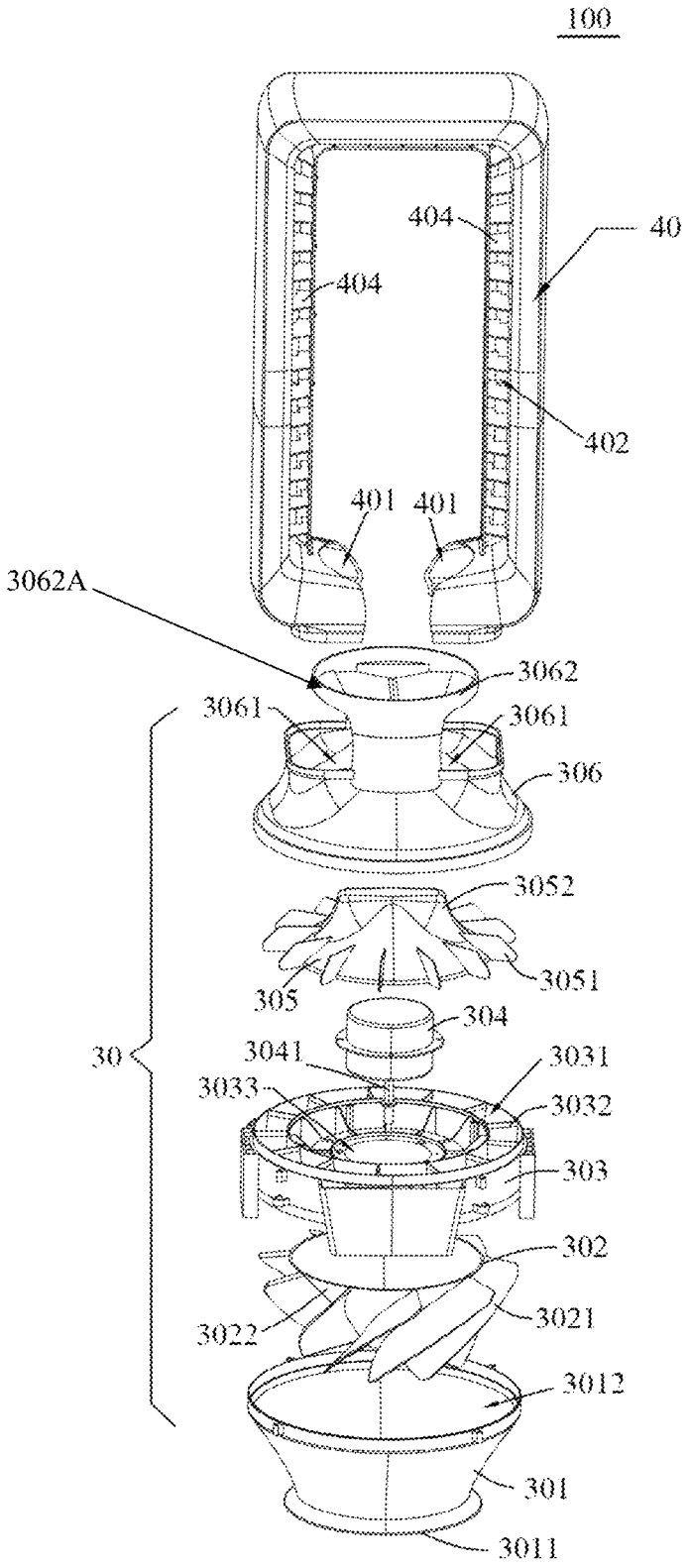
FIG. 3 is an exploded schematic diagram of a bladeless cooling fan component and an air outlet component according to an embodiment of the present application.

In conjunction with FIG. 3, both the water cooling component 20 and the wind wheel component 30 are accommodated in the fan body 10, wherein the water cooling component 20 is provided in cooperation with the air inlet 101 on the fan body 10 to cool the air entering the fan body 10 through the air inlet 101 of the fan body 10, the wind wheel component 30 is arranged to further use the air in the fan body 10 to generate an air flow, and the air outlet component 40 can receive the generated air flow from the fan body 10 and guide the air flow to be ejected to the set direction.

In the conventional usage scenario of the bladeless cooling fan 100, the fan body 10 is placed on a suitable supporting plane (such as a floor surface or a desktop), and the air outlet component 40 is installed on the fan body 10, so that the fan body 10 and the air outlet component 40 generally constitute a user-facing appearance. The air outlet component 40 may be configured to eject the cooled or uncooled air flow to the set direction, and may be configured to pivot relative to the fan body 10 to face a wider-angle use space.

It should be noted that the embodiments/examples shown hereinafter will also use the normal use state of the bladeless cooling fan 100 as a position reference. For example, in such embodiments/examples, the air outlet component 40 may be described as being located on the upper part of the fan body 10.

In the above embodiment of the bladeless cooling fan 100, the range of the air flow ejected by the air outlet component 40 is actually determined by the air outlet 402 thereon, rather than being directly limited to the rotating blades driven by the motor 304. Therefore, the air outlet component 40/air outlet 402 can be arranged in a more reasonable manner to improve the overall utilization efficiency of the space. At the same time, the water cooling component 20 provides an active cooling function, so that the air flow finally ejected by the air outlet component 40 has an initial temperature lower than the ambient temperature, thereby providing a more efficient "cool" experience for the user.

In an embodiment, the air inlet 101 is provided around the fan body 10. The "around" here means that the air inlet 101 is arranged in the direction around the central axis of the fan body 10, so that the air can enter the fan body 10 from four sides of the fan body 10 to increase the air intake. Also, an outlet component air inlet 401 may comprise an array of holes formed on the fan body 10 to maintain the integrity of the appearance of the fan body 10. Here, the air inlet 101 provided around may be a preferred embodiment. Alternatively, the air inlet may also be the part arranged only around the direction of the central axis of the fan body 10.

Figure 4:
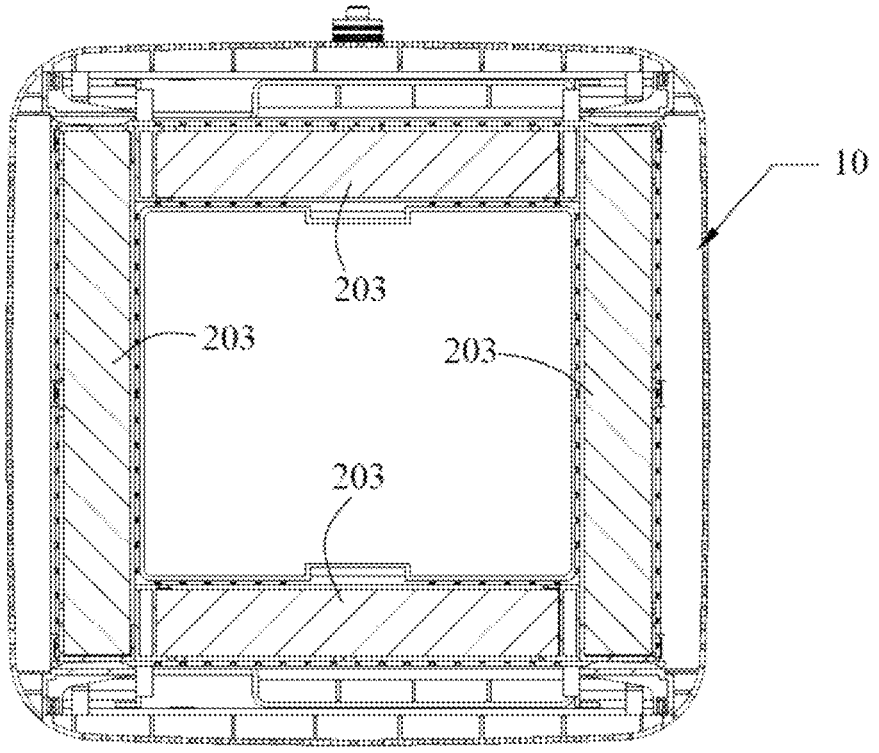
FIG. 4 is a cross-sectional diagram of a fan body of a bladeless cooling fan in the plane direction perpendicular to the axis line according to an embodiment of the present application.

In conjunction with FIG. 4, the fan body 10 may be designed into a suitable shape according to requirements, for example, a cylindrical shape. In this embodiment, in the plane direction perpendicular to the central axis of the fan body 10, the cross section of the fan body 10 is rectangular, that is, the fan body 10 is substantially rectangular. Of course, in the actual processing design, the corners of the rectangular fan body part 10 can also be processed as corresponding rounded corners, and can be constructed as a rounded rectangular appearance.

In an embodiment, the water cooling component 20 comprises a water tank 201, a water pump 202, wet curtain paper 203, an upper water receiving tray 204 and a lower water receiving tray 205 which cooperate with the wet curtain paper 203. When the bladeless cooling fan 100 needs to eject a lower temperature air flow, the water cooling component 20 can be controlled to start operating. In the specific operating process, the water pump 202 is used to first lift the water in the water tank 201 to the upper water receiving tray 204; the upper water receiving tray 204 is provided above the wet curtain paper 203, and for example, is provided with a water falling hole (unlabelled in the drawings), so that the water in the upper water receiving tray 204 can be transported to the wet curtain paper 203 under the action of gravity. When the air outside the fan body 10 enters the fan body 10 from the air inlet 101, the air will first pass through the wet curtain paper 203 gotten wet, and the wet curtain paper 203 will absorb the heat in this part of air at this time so as to lower its temperature. The lower water receiving tray 205 is provided below the wet curtain paper 203 for recycling excess water falling through the wet curtain paper 203, and the lower water receiving tray 205 may be further communicated with the water tank 201 to transport the recycled water to the water tank 201 again, so as to realize the recycling of water in the water tank 201.

Figure 22:
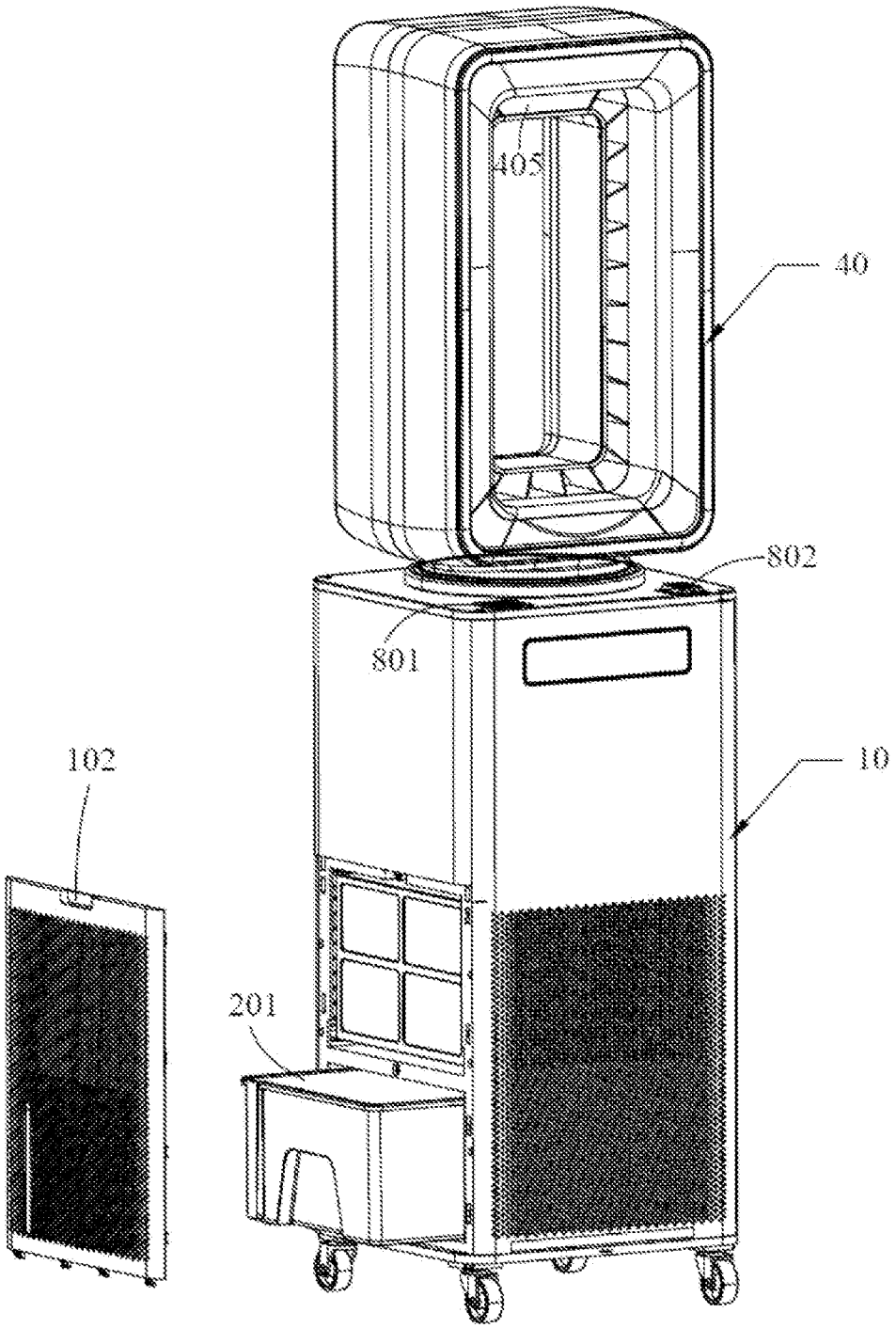
FIG. 22 is a schematic structural diagram of a bladeless cooling fan with its side plates opened in an embodiment of the present application.
Figure 23:
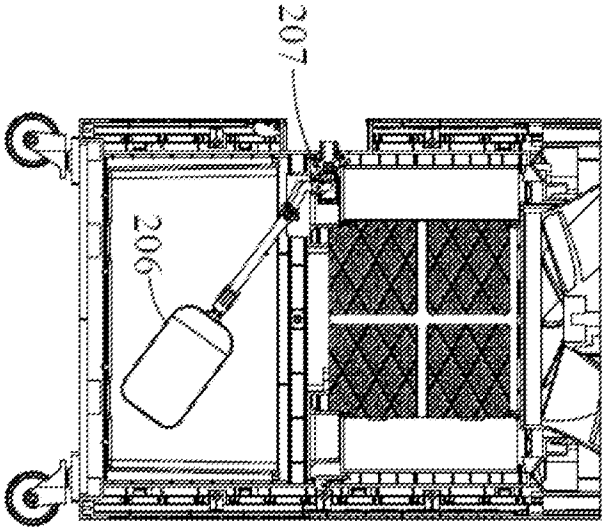
FIG. 23 is a schematic structural diagram of the matching of a float and a water adding valve in a water tank of a bladeless cooling fan according to an embodiment of the present application.

Referring to FIGS. 22 to 23, the water tank 201 can be further connected to an external water source through an automatic water adding valve 207, and the water adding valve 207 is matched with a float 206. After the water level in the water tank 201 reaches the standard water level, the float 206 floats to close the water adding valve 207. When the water level in the water tank 201 is lower than the standard water level, the float 206 descends to open the water adding valve 207, thereby maintaining the water level in the water tank 201. Of course, the side of the fan body 10 is also provided with an opening. By opening the corresponding side plate 102, the user can directly take out the water tank 201 from the opening to add water and clean the water tank 201.

In the embodiment where the fan body 10 is rectangular, the wet curtain paper 203 may be preferably arranged in four pieces and surround each other into a square tubular cooling cavity 61. The air entering the fan body 10 through the air inlet 101 reaches the cooling cavity 61 after passing through the wet curtain paper 203. The wind wheel component 30 may further drive the cooling air in the cooling cavity 61 to generate an air flow. The wet curtain paper 203 provided around the four sides cooperates with the air inlet 401 provided "around", which can effectively improve the cooling efficiency of the air, thereby increasing the air volume.

Of course, in the state where the water cooling component 20 is not operating, the wet curtain paper 203 is in a relatively dry state. The air reaching the cooling cavity 61 through the wet curtain paper 203 will not be reduced in temperature. In this case, the wind wheel component 30 can still drive the air in the cooling cavity 61 to generate an air flow close to the ambient temperature.

It should be noted that the relationship between the shape of the fan body 10 and the arrangement of the wet curtain paper 203 is exemplarily explained here from the perspective of industrial design. In some embodiments, the rectangular fan body may be, for example, a sheet of wet curtain paper rolled into a cylindrical shape; or, the cylindrical fan body may be, for example, four sheets of wet curtain paper arranged into a square tubular cooling cavity as described above. These alternative embodiments should be considered as not exceeding the scope of protection of the present application.

The wind wheel component 30 according to an embodiment of the present application comprises a diagonal flow wind wheel 302, which is a wind wheel between an axial flow wind wheel and a centrifugal wind wheel. When diagonal flow wind wheel performs the axial rotation, the disturbed air can perform both centrifugal movement and axial movement, which has the advantages of the axial flow wind wheel and the centrifugal wind wheel. It has a large air volume, a high air pressure and a fast air speed. Due to the overall and air channel design of the wind wheel component 30 described below, the bladeless cooling fan 100 has an ideal air outlet effect.

In an embodiment, the wind wheel component 30 may comprise a first volute 301 and a second volute 303 cooperated with each other, the first volute 301 is cooperated with the second volute 303 to form a wind wheel cavity 3012 accommodating the diagonal flow wind wheel 302, the first volute 301 is provided with a first volute opening 3011 through which the air cooled by the water cooling component 20 enters, and the second volute 303 is provided with a second volute opening 3031 through which air flow generated by the diagonal flow wind wheel 302 exits. The shape of the first volute 301 conforms to the shape of the diagonal flow wind wheel 302 and is roughly conical. The second volute 303 can also be regarded as the "cover" of the first volute 301, cooperating the first volute 301 to define the diagonal flow wind wheel 302 in the wind wheel cavity 3012.

The second volute opening 3031 corresponds to the blade 3021 outside the diagonal flow wind wheel 302, and therefore, the second volute opening 3031 may be provided in a ring shape. The ring width of the ring-shaped second volute opening 3031 is approximately equal to the height of the blade 3021, of the diagonal flow wind wheel 302 of the part adjacent thereto, protruding from the body 3022 of the diagonal flow wind wheel 302 to cooperate the flowing of the air flow.

Since the air flow generated from the diagonal flow wind wheel 302 is a rotating air flow having both axial movement and centrifugal movement, in order to guide the air flow generated by the diagonal flow wind wheel 302 to move in the set direction, in an embodiment, a plurality of first deflectors 3032 are arranged at intervals radially in the second volute opening 3031, and the first deflector 3032 extends in the direction away from the first volute 301, which is substantially the same as the direction of air flow through the second volute opening 3031. The first deflector 3031 provided in this way can rectify the air flow passing therethrough. Preferably, the first deflectors 3032 are evenly arranged at intervals within the second volute opening 3031.

The middle part of the second volute 303 can also be formed with an installing space 3033 for accommodating the motor 304 driving the diagonal flow wind wheel 302 to rotate. A motor shaft 3041 passes through the middle part of the second volute 303 and extends into the wind wheel cavity to be axially connected with the diagonal flow wind wheel 302.

In an embodiment, the wind wheel component 30 further comprises a third volute 306 cooperated with the second volute 303 to form a deflector cavity 62, the third volute 306 is provided with a third volute opening 3061 through which air flow exits, a deflector cover 305 is provided in the deflector cavity 62, and the deflector cover 305 has a gradually decreasing cross-sectional area in a direction extending from the second volute 303 to the third volute 306 as a whole so as to guide the air flow flowing into the deflector cavity 62 through the second volute opening 3031 to the third volute opening 3061.

In order to further guide the flow direction of the air flow generated by the diagonal flow wind wheel 302, a plurality of second deflectors 3051 respectively corresponding to the plurality of first deflectors 3032 are provided on the deflector cover 305, and the second deflectors 3051 are parallel to the central axis of the deflector cover 305. In this way, any pair of first deflectors 3032 and second deflectors 3051 corresponding to each other is equivalent to providing a continuous flow path constraint in the air flow direction. In the above description, it has been known that the first deflector 3032 preliminarily rectifies the air flow passing through the second volute opening 3031. Here, when the air flow reaches the second deflector 3051 along the first deflector 3032, it will be rectified again, so that the air flow generated by the diagonal flow wind wheel 305 finally flows in the set direction (that is, the vertical upward flow direction in the normal use state). In addition, the "two-stage" rectification is performed on the air flow through the continuous cooperation of the first deflector 3032 and the second deflector 3051, which can reduce the loss of air flow in the rectification process.

The third volute opening 3061 corresponds to the air inlet 401 of the air outlet component 40. The air flow flows from the third volute opening 3061 into the air inlet 401 of the air outlet component 40, and is finally guided to be ejected from the air outlet 402 of the air outlet component 40. The third volute 306 further comprises a deflector part 3062 provided at the third volute opening 3061, and the deflector part 3062 has an outer profile that gradually changes in the direction of the third volute opening 3061 toward the direction of the air inlet 401, so that at least part of the air flow exiting through the third volute opening 3061 is guided to the air inlet 401.

In an embodiment, the third volute 306 is symmetrically provided with two of the third volute openings 3061. Correspondingly, a deflector fin 3052 cooperated with the inner wall of the third volute 306 is formed on the deflector cover 305, and the deflector fin 3052 divides the deflector cavity 62 into two parts corresponding to the two third volute openings 3061, so that the deflector cover 305 can guide the air flow in the two parts of the deflector cavity 62 to the corresponding third Volute opening 3061.

Suitably, in such an embodiment, two air inlets 401 on the air outlet component 40 may also be provided corresponding to the third volute opening 3061. In order to guide the air flow into the air inlet 401, the deflector part 3062 of the third volute 306 here has a substantially gradually increasing cross-sectional area in the direction away from the third volute opening 3061, so that the air flow passing through the deflector 3062 will be guided to flow into the two air inlets 401 provided on opposite sides.

In the above embodiments/examples, the corresponding functions of the water cooling component 20 and the fan component 30 may be controlled by, for example, a built-in controller, and for example, cooperate with a receiver and a remote controller, an integrated control panel, etc., so that the user can adjust the above functions of cooling and ejecting air flow as needed. The controller here may be an integrated circuit comprising a Micro Controller Unit (MCU). It is well known to those skilled in the art that the MCU may comprise a Central Processing Unit (CPU) and a Read-Only Memory (ROM), a Random Access Memory (RAM), a timing module, a Digital-Analog Converter (A/D Converter), and several input/output ports. Of course, the controller may also use other forms of integrated circuits, such as Application Specific Integrated Circuits (ASIC) or Field-Programmable Gate Arrays (FPGA).

Figure 5:
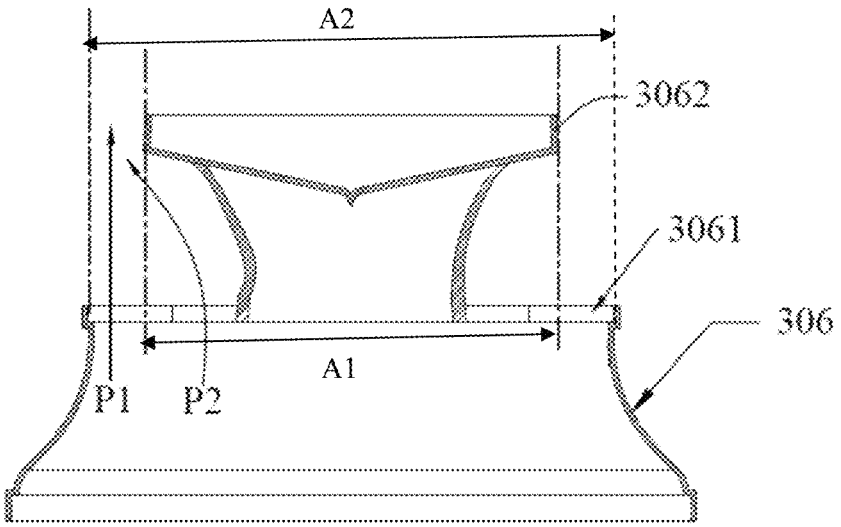
FIG. 5 is a schematic structural diagram of a third volute of a bladeless cooling fan according to an embodiment of the present application.

In conjunction with FIG. 5, in an embodiment, on the plane perpendicular to the central axis of the third volute 306, a part of the outer edge 3062A of the projection A1 of the deflector part 3062 is located in the projection A2 of the third volute opening 3061. In this way, at least part of the air exiting through the third volute opening 3061 (as indicated by reference number P1) will not interfere with the deflector part 3062 of the third volute 306, but directly flows into the air inlet 401 of the air outlet component 40, which will directly increase the air intake of the air outlet component 40 on the one hand, and will reduce the energy loss of this part of air flow because it will not interfere with the deflector part 3062 of the third volute 306 on the other hand, thereby indirectly increasing the air inlet pressure at the air inlet 401. Of course, in order to make full use of the generated air flow, the remaining part of air flow will be guided by the deflector part 3062 into the air inlet 401 along the path indicated by "reference number P2".

Figure 6:
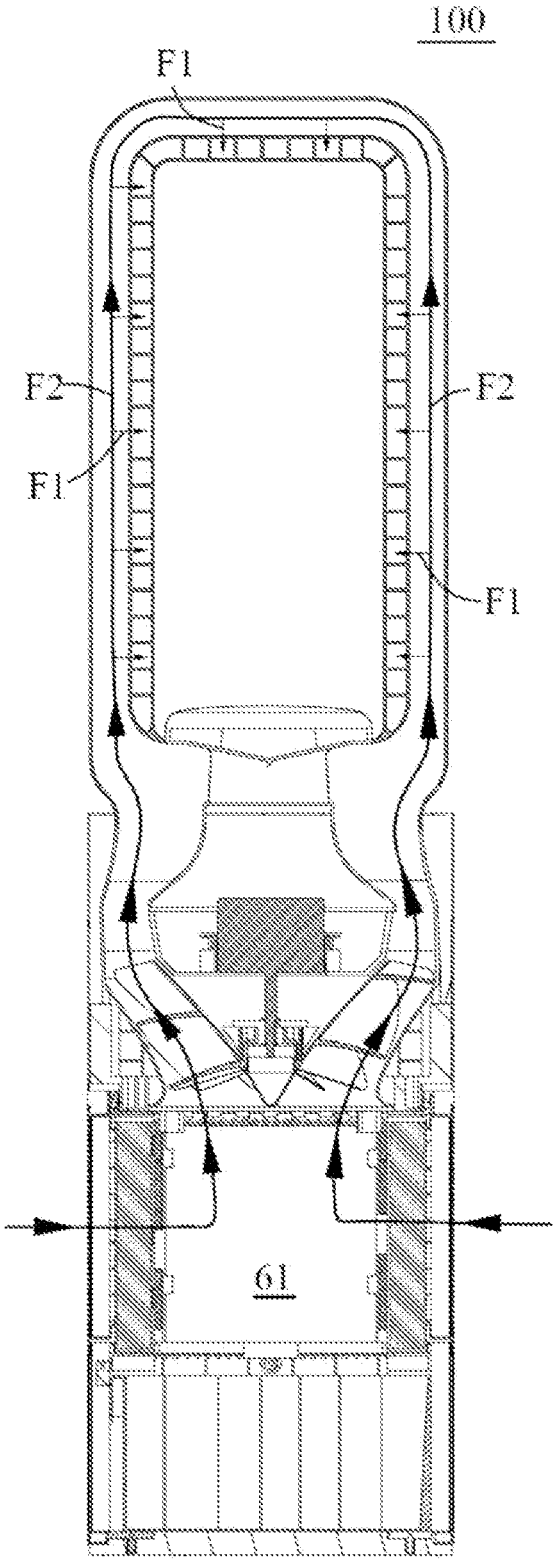
FIG. 6 is a schematic diagram of the flow direction of the air flow inside a bladeless cooling fan according to an embodiment of the present application.

In conjunction with FIG. 6, the labeled line with arrows in the figure shows the flow direction (also may be referred to as an air channel) of the air flow in the bladeless cooling fan 100. In the flow direction of the air flow generated by the diagonal flow wind wheel 302, the air flow first reaches the deflector cavity 62 through the second volute opening 3031. The air flow in the deflector cavity 62 flows into the air inlet 401 of the air outlet component 40 from the third volute opening 3061, and finally exits through the air outlet 402 of the air outlet component 40. It can be seen that in this process, the second volute opening 3031 and the third volute opening 3061 are not directly butted, and the air inlet 401 and the air outlet 402 are not directly butted either. In order to ensure that the air flow will not dissipate too much when flowing between these components, in an embodiment, the area of the second volute opening 3031≤the sum of the areas of the third volute openings 3061=the sum of the areas of the air inlets 401≤the area of the air outlet 402. In this way, in the flow direction of air flow, the air flow passing through can be received as much as possible, so that the air outlet 402 of the air outlet component 40 can form a high air pressure and a high air volume.

Figure 7:
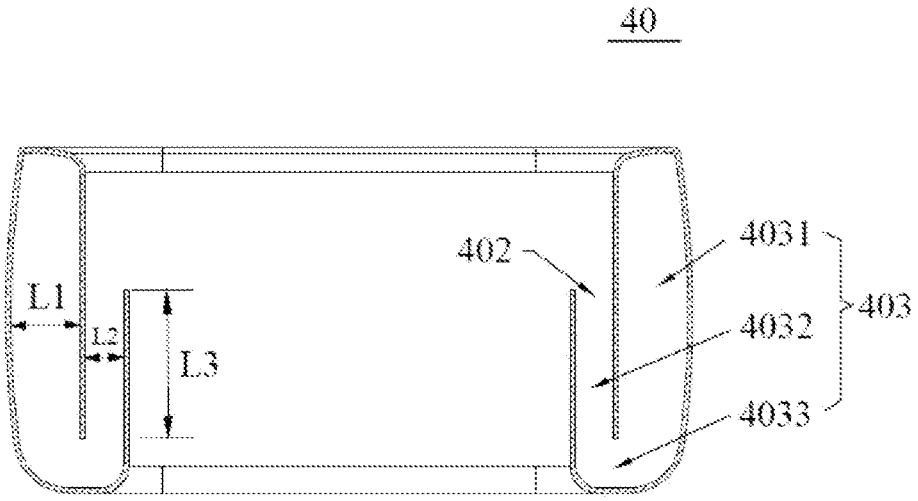
FIG. 7 is a schematic cross-sectional diagram of an air outlet component in the plane direction perpendicular to the extending direction of the air outlet component in a bladeless cooling fan according to an embodiment of the present application.
Figure 8:
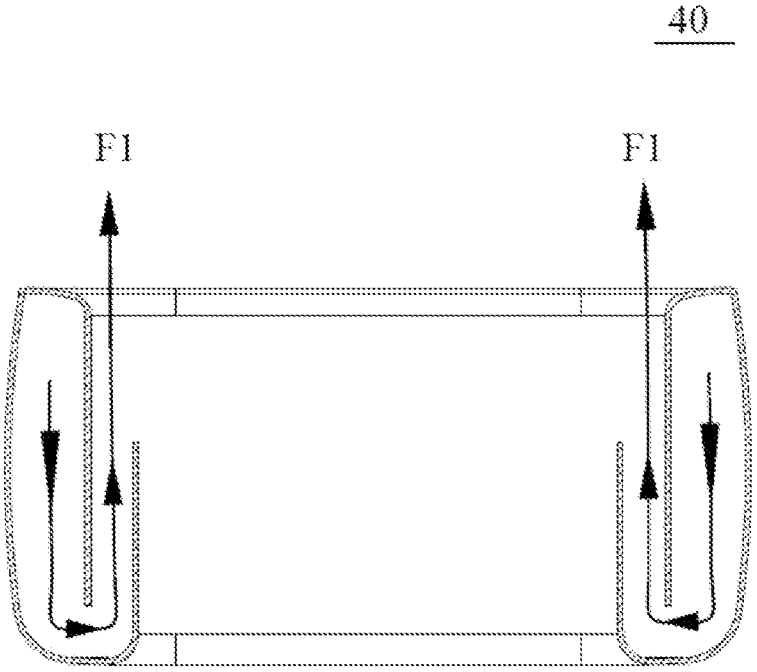
FIG. 8 is a schematic diagram of the flow direction of a first path of the air flow in an internal channel in a bladeless cooling fan according to an embodiment of the present application.

In conjunction with FIGS. 7 and 8, the bladeless cooling fan 100 of the present application directly ejects air flow into the space through the air outlet component 40. The air outlet component 40 comprises an air outlet 402, an air inlet 401, and an internal channel 403 that transports air flow from the air inlet 401 to the air outlet 402. Since there is no need to directly generate air flow facing the user depending on the impeller in the conventional fan, the air outlet 402 here can be designed into a suitable form as needed. For example, the air outlet 402 may be provided in a long shape, or an open ring, etc. In the following embodiments and drawings, the air outlet 402 is generally U-shaped to specifically describe the solution of the present application, but this is not a limitation on the form of the air outlet 402 of the present application.

The internal channel 403 of the air outlet 402 comprises a first channel part 4031, a second channel part 4032, and a bending channel part 4033 connecting the first channel part 4031 and the second channel part 4032, wherein the first channel part 4031 corresponds to the air inlet 401 to receive the air flow entering from the air inlet 401, and the end of the second channel part 4032 defines the air outlet 402. As shown in FIG. 7 and FIG. 8, the air outlet 402 has a substantially clip shape in a cross-sectional view at this time. The purpose of providing the second channel part 4032 is to pressurize the air flow received by the first channel part 4031 again and then eject the air flow, while controlling the ejecting direction of air flow.

In an embodiment, in the plane direction perpendicular to the extending direction of the air outlet 402 (that is, the cross-sectional direction of the air outlet shown in FIG. 7), the first channel part 4031 and the second channel part 4032 are substantially parallel, and the air flow has substantially opposite flow directions in the first channel part 4031 and the second channel part 4032. The air flow in the first channel part 4031 is guided by the bending channel part 4033 and finally folds into the second channel part 4032 and is ejected from the air outlet 402. In the present application, this air flow path in the air outlet component 40 is referred to as the first path F1. Correspondingly, the air flow also flows in the direction in which the first channel part 4031 extends axially as a whole. In the present application, this air flow path in the air outlet component 40 is referred to as the second path F2. It can be understood that the first path F1 and the second path F2 of the air flow may coexist with each other in the air outlet component 40, and in the actual air flow process, the two paths cannot be strictly distinguished. Here, the flow path of the air flow is divided into the first path F1 and the second path F2 only for clarity and convenience of description, rather than having a strict limitation.

In an embodiment, in the plane direction perpendicular to the extending direction of the air outlet 402, the width L1 of the first channel part 4031>the width L2 of the second channel part 4032≥one third of the width L1 of the first channel part 4031 so as to ensure that the air flow can be ejected from the air outlet 402 and an appropriate air pressure and an appropriate air speed are kept. Because the bladeless cooling fan 100 of the present application can be driven by air with reduced temperature to generate air flow, the initial temperature of the air flow itself is low, and it is not necessary to drive the air around the air outlet 402 to achieve the desired "cool" experience depending on an excessively high air pressure and air speed. In this way, the second channel part 4032 does not need to be provided to be too narrow relative to the first channel part 4031, resulting in possible impact on air flow utilization efficiency.

In an embodiment, in the plane direction perpendicular to the extending direction of the air outlet 402, the width L2 of the second channel part 4032<the length L3 of the second channel part 4032, and a plurality of third deflectors 404 are arranged at intervals in the direction in which the air outlet 402 extends, and the central axis of the hole defined by any two adjacent third deflectors is substantially parallel to the direction in which the air flow of the air outlet component is ejected. Preferably, the width of the second channel part 4032 here is approximately equal to a half of its length so as to ensure that the air flow ejected from the air outlet 402 can reduce the diffusion all around, restricting the directivity of the ejected air flow, increasing the ejecting distance of the air flow, and improving the use experience of the bladeless cooling fan 100.

With reference to FIGS. 11 to 17, a heating component 405 and a wind deflector 407 are provided in the internal channel 403 of the air outlet 402. The heating component 405 is connected with a driving component 406, and the driving component 406 can drive the heating component 405 to move between the first channel part 4031 and the second channel part 4032. In an embodiment, the main body of the heating component 405 is provided in a frame shape matching the shape of the air outlet 402, and comprises two parts which can be matched with the second channel part 402 in the vertical direction, so that the flowing air flow can be heated well. The wind deflector 407 is strip-shaped as a whole, and is connected with a driving component 408. The driving component 408 can drive the strip-shaped wind deflector 407 to rotate along its axial direction, thereby closing or opening at least part of the air outlet 402. In an embodiment, the wind deflector 407 is configured at the air outlet 402 at the lower part of the air outlet component 40, so that the air outlet 402 at the lower part of the air outlet component 40 can be driven to be closed or opened.

Figure 12:
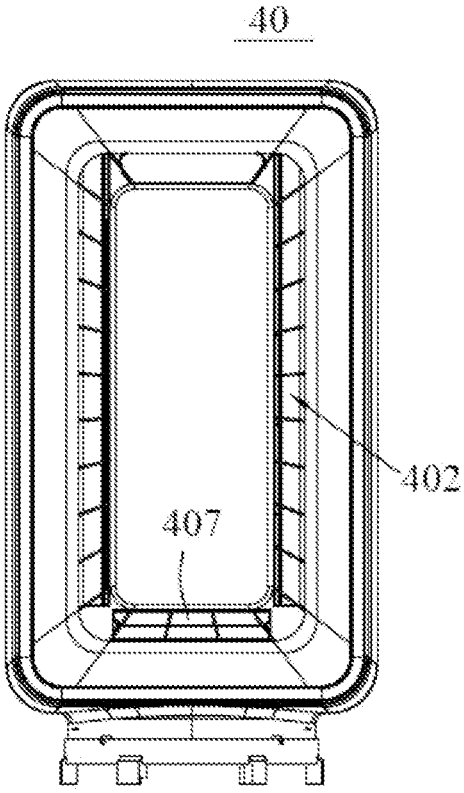
FIG. 12 and FIG. 13 are structural diagrams of an air outlet component from different perspectives in the heating state of a bladeless cooling fan according to an embodiment of the present application.
Figure 13:
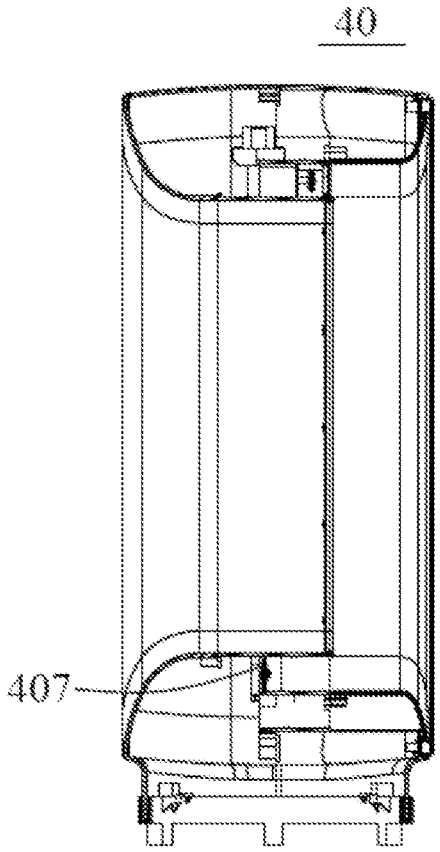
Figure 14:
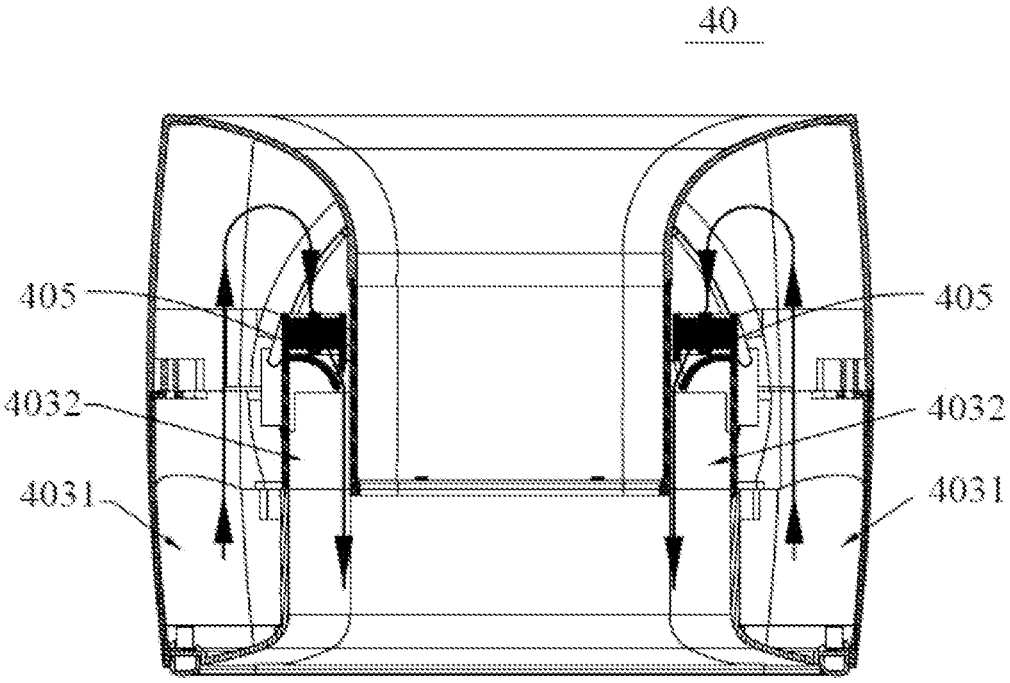
FIG. 14 is a schematic cross-sectional diagram of an air outlet component in a plane direction perpendicular to the extending direction of the air outlet component in the heating state of a bladeless cooling fan according to an embodiment of the present application.

With reference to FIGS. 12 to 14, when the bladeless cooling fan 100 is in a heating state, the driving component 406 drives the heating component 405 to a closed position (fitted in the second channel part 4032), and the driving component 408 drives the wind deflector 407 to close the air outlet 402 at the lower part of the air outlet component 40, so that air flows through the heating components 405 on both sides of the air outlet component 40 in the vertical direction and is heated and sent out of the air outlet 402. At this time, the wind wheel component 30 of the bladeless cooling fan 100 can be in a low-speed operation state to ensure that the air flow is sufficiently heated.

Figure 15:
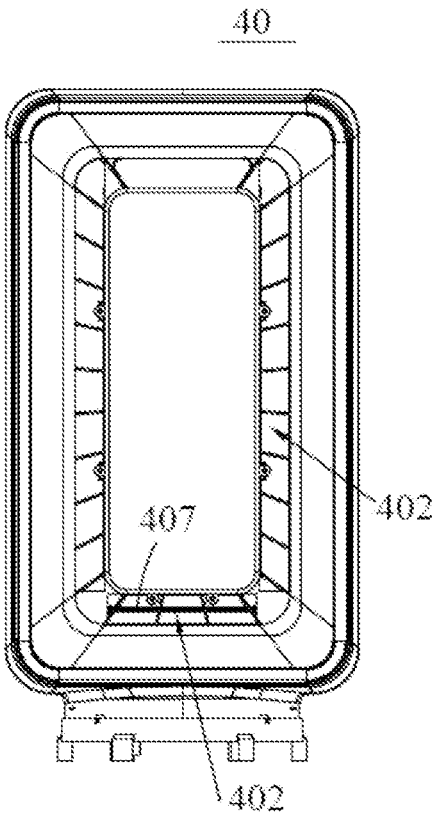
FIG. 15 and FIG. 16 are structural diagrams of an air outlet component from different perspectives in the non-heating state of a bladeless cooling fan according to an embodiment of the present application.
Figure 16:
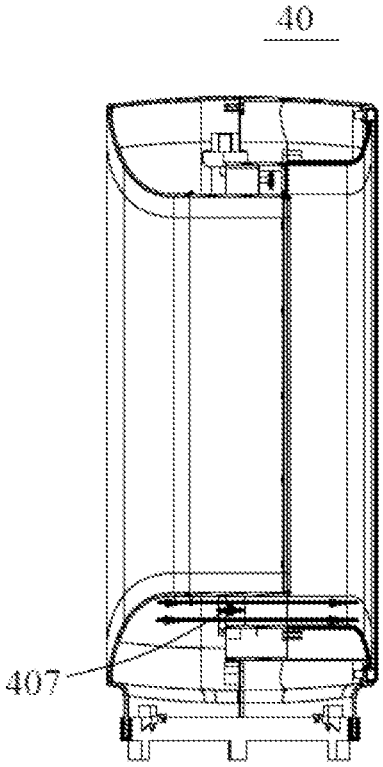
Figure 17:
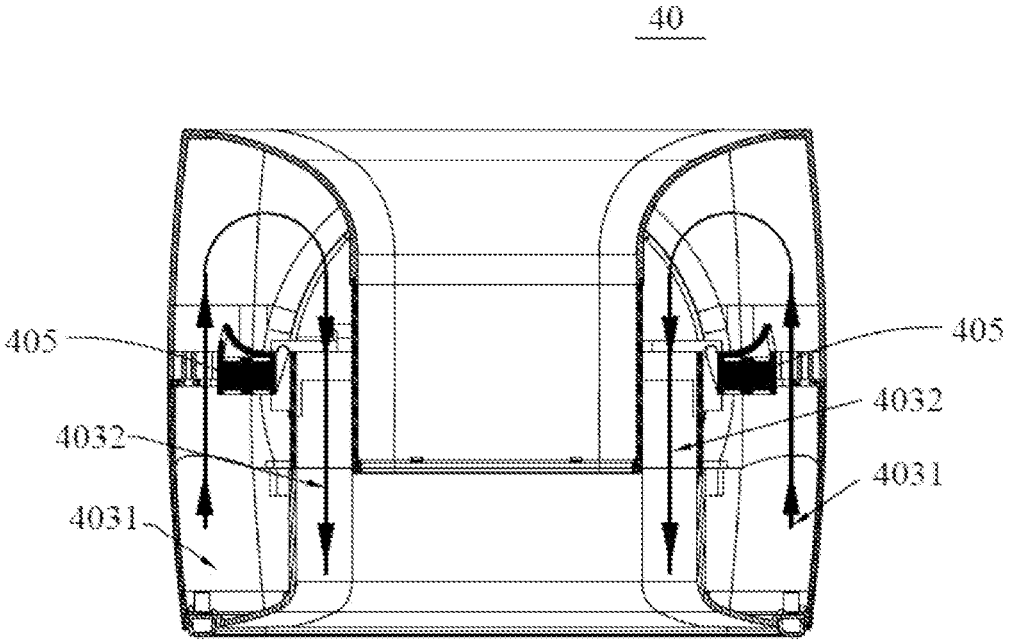
FIG. 17 is a schematic cross-sectional diagram of an air outlet component in a plane direction perpendicular to the extending direction of the air outlet component in the non-heating state of a bladeless cooling fan according to an embodiment of the present application.

With reference to FIGS. 15 to 17, when the bladeless cooling fan 100 is in a non-heating state, the driving component 406 drives the heating component 405 to an open position (fitted in the first channel portion 4031), and the driving component 408 drives the wind deflector 407 to open the air outlet 402 at the lower part of the air outlet component 40, so that the air flow is normally emitted from the air outlet 402 of the air outlet component 40.

Figure 18:
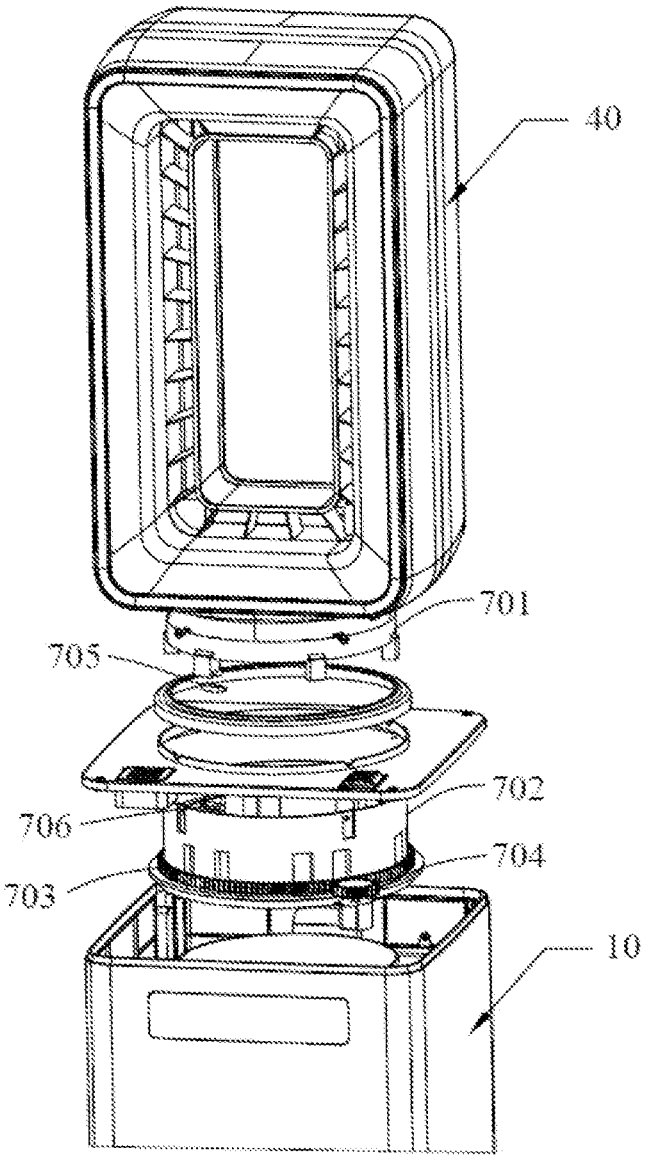
FIG. 18 is an exploded diagram of the connection structure between an air outlet component and a fan body of a bladeless cooling fan according to an embodiment of the present application.
Figure 19:
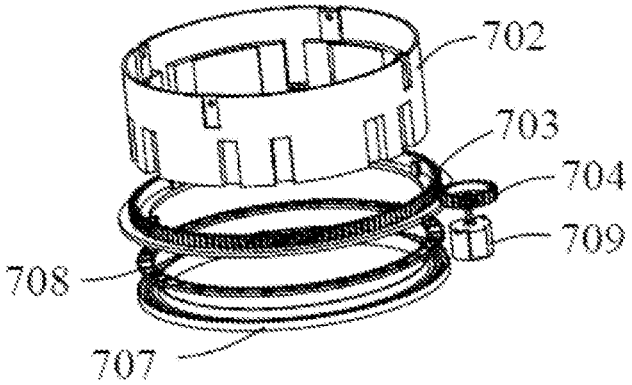
FIG. 19 and FIG. 20 are assembly schematic diagrams of the connection structure between an air outlet component and a fan body of a bladeless cooling fan according to an embodiment of the present application.
Figure 20:
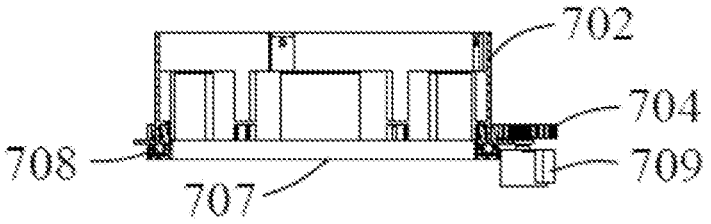

The air outlet component 40 can rotate and sweep air at most 360 degrees relative to the fan body 10. With reference to FIGS. 18 to 20, the air outlet component 40 is connected with a mounting limiting base 701, and the fan body 10 is rotatably connected with a mounting base 702. The air outlet component 40 is rotatably connected with the fan body 10 through the matching of the mounting limiting base 701 and the mounting base 702.

A first position sensor 705 is provided on the mounting limiting base 701, a second position sensor 706 is provided on the mounting base 702, and the bladeless cooling fan 100 controls the rotation angle of the air outlet component 40 relative to the fan body 10 through the detection results of the first position sensor 705 and the second position sensor 706. For example, the reference point of the air outlet component 40 relative to the fan body 10 can be reset through the alignment of the first position sensor 705 and the second position sensor 706. For another example, a rotation angle of 0 to 360 degrees may be set according to the reference point.

In a specific structure, an annular mounting cover 707 and an annular driven gear 703 assembled on the mounting cover 707 are fixed on the fan body 10, a ball bearing component 708 is provided between the mounting cover 707 and the driven gear 703, and the bladeless cooling fan 100 further comprises a driving component 704 and a driving gear 704 connected with the driving component 704 and meshed with the driven gear 703. This way of gear transmission in conjunction with ball bearings can reduce the rotational friction when the air outlet component 40 rotates, and ensure the smooth rotation.

Figure 21:
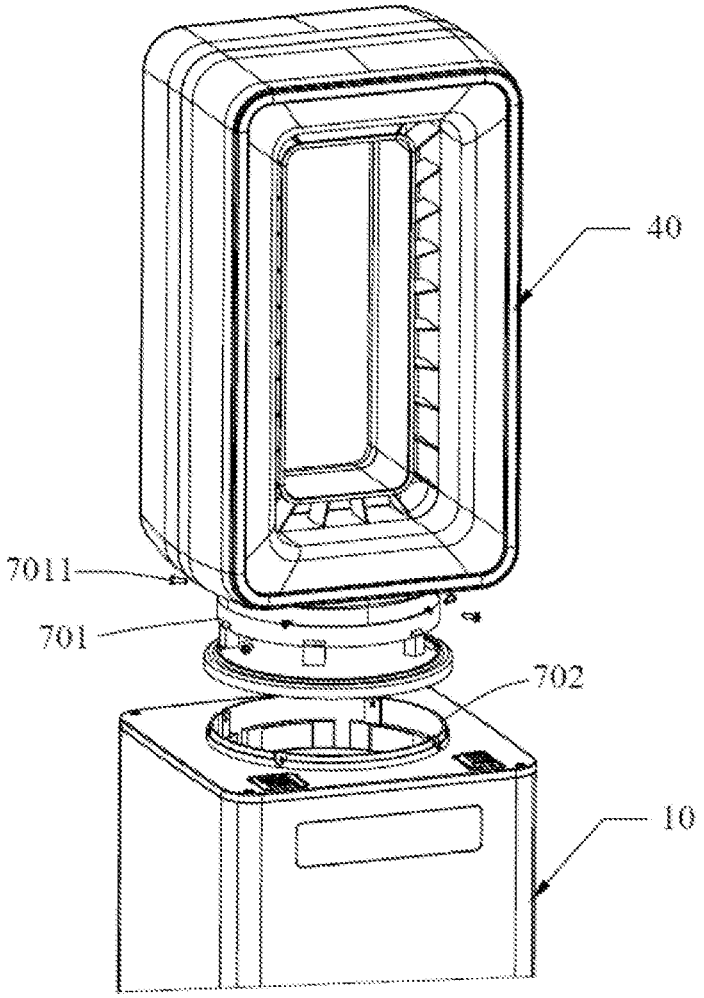
FIG. 21 is an exploded diagram of the connection structure between an air outlet component and a fan body of a bladeless cooling fan according to an embodiment of the present application.

With reference to FIG. 21, the connection between the air outlet component 40 and the fan body 10 comprises mechanical connection and electrical connection. The mounting limiting base 701 and the mounting base 702 are mechanically connected by screws 7011, and the air outlet component 40 is provided with a telescopic connecting wire (not shown) equipped with a quick connector, thereby realizing electrical connection with the corresponding plug-in part of the fan body 10. With this arrangement, the air outlet component 40 can be easily replaced, thus meeting different needs of users.

In the air outlet component 40, since the flow speed of the air flow generally has a gradually decreasing trend in the direction away from the air inlet 401, and especially in the position adjacent to the air inlet 401, the flow speed of the air flow is generally higher, the air flow is less likely to be ejected from the air outlet 402 through the above first path F1, so that the air outlet effect of the air outlet 402 adjacent to the air inlet 401 is poor. Therefore, in the following embodiments, the present application further provides corresponding improvement methods.

Figure 9:
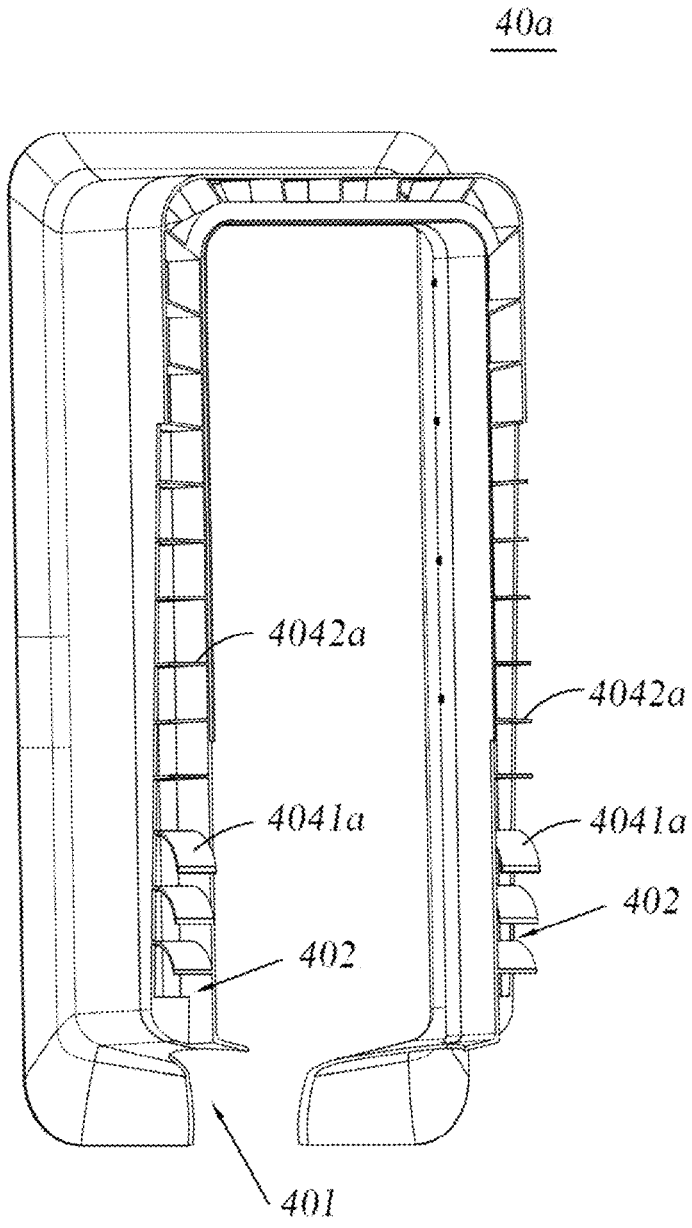
FIG. 9 is a schematic structural diagram of an air outlet component of a bladeless cooling fan according to an embodiment of the present application.
Figure 10:
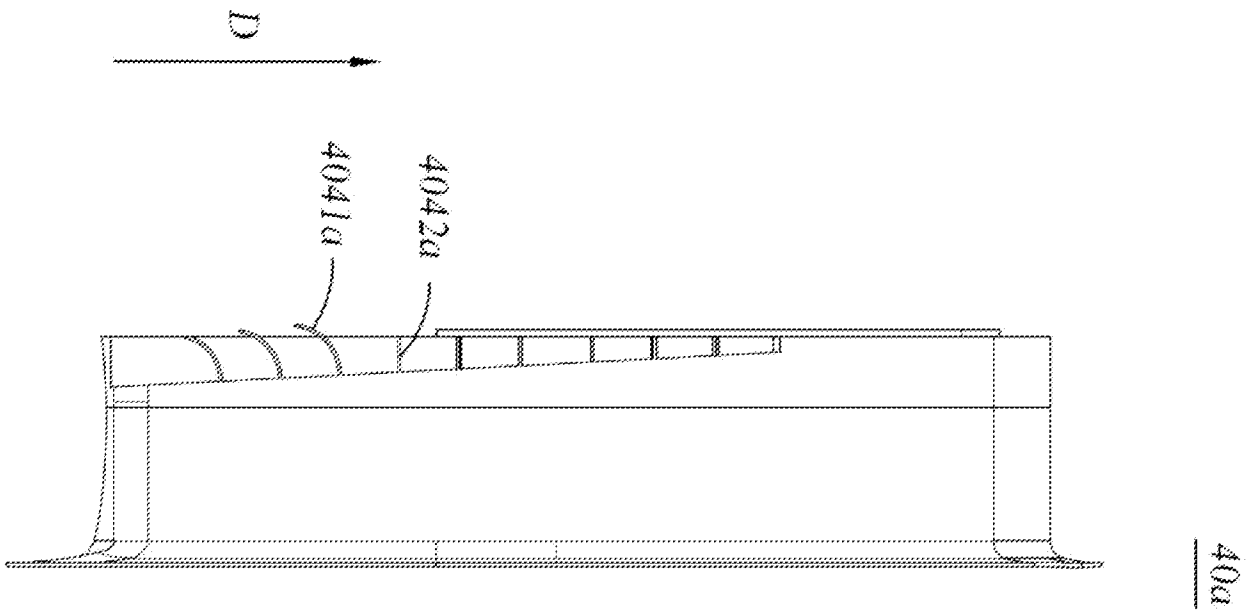
FIG. 10 is a partial cross-sectional diagram of an air outlet component in the embodiment shown in FIG. 9.
Figure 11:
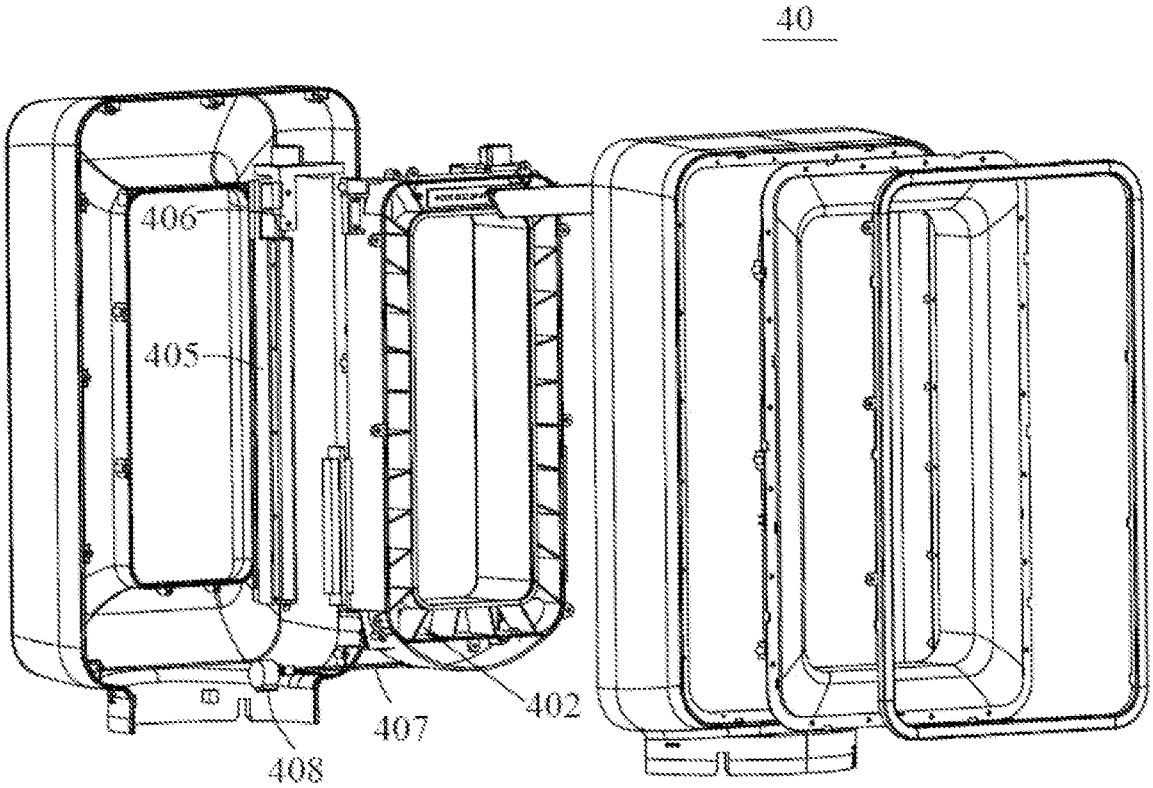
FIG. 11 is an exploded diagram of an air outlet component of a bladeless cooling fan according to an embodiment of the present application.

Referring to FIGS. 9 and 10, in this embodiment, the extending length of the third deflector 4041*a* at least partially adjacent to the air inlet 401 is greater than that of the remote deflector 4042*a* remote from the air inlet 401. The "extending length" of the third deflector refers to the extending length in the direction in which the air flow of the air outlet component 40*a* is ejected. In this way, the third deflector 4041*a* in this part can have relatively higher air flow trapping capability. Even when the air flow speed is high, the air outlet 402 at the corresponding position can be ensured to have normal air outlet function.

The third deflector 4041*a* adjacent to the air inlet 401 may also have a gradually increasing extending length in the direction away from the air inlet 401 (direction D in FIG. 10), so as to ensure the overall air flow trapping capability. At the same time, the third deflectors 4041*a* may be provided in an arc-shaped sheet shape bent toward the air inlet 401 to obtain a better air flow trapping effect than the flat-shaped remote deflector 4042*a*.

In the drawings of this embodiment, the scheme of the present application is exemplarily illustrated by taking the example that the air outlets at both sides of the air outlet component 40*a* are respectively provided with three third deflectors 4041*a* in this "special form". However, it can be understood that the specific number of the third deflectors in this "special form" can be adjusted according to requirements. For example, one third of the deflectors adjacent to the air inlet in the axial direction of the air outlet component can be provided in this form.

Referring to FIG. 22, in more embodiments, in order to realize functions such as HEPA, plasma purification, humidification, lighting and atmosphere lamps, aromatherapy and mosquito repellent lamps, corresponding functional modules can also be configured on the bladeless cooling fan 100. Taking functions of aromatherapy, mosquito repellent and lighting/atmosphere lamps as an example, FIG. 21 shows an embodiment where an aromatherapy module 801, a mosquito repellent module 802 and a lighting/atmosphere lamp 405 are configured.

Moreover, it should be understood that although the terms such as a first, a second, etc. may be used herein to describe various elements or structures, these described objects should not be limited by these terms. These terms are only used to distinguish these described objects from each other. For example, a first deflector may be referred to as a second deflector, and similarly a second deflector may also be referred to as a first deflector, without departing from the scope of protection of the present application.

Moreover, the same reference numerals or sips may be used in different embodiments, but this does not represent a structural or functional connection, but is merely for convenience of description.

The terms such as "upper", "above", "lower", "below", etc. used in the present invention to indicate the space relative position are used to describe the relationship of one unit or feature with respect to another unit or feature as shown in the drawings for convenience of illustration. The term spatial relative position may be intended to include different orientations of the device other than those shown in the drawings during use or operation. For example, if the device in the drawings is turned over, the units described as "below" or "beneath" other units or features will be "above" other units or features. Thus, the exemplary term "below" can encompass both the orientations of above and below. The device can be oriented in other ways (rotated by 90 degrees or at other orientations) and interpret the space-related descriptors used in the present invention accordingly.

When a component or layer is referred to as being "on" or "connected to" another component or layer, it can be directly on another component or layer or be connected to another component or layer, or there may be an intermediate component or layer. In contrast, when a component is referred to as being "directly on another component or layer" or "directly connected to another component or layer", there cannot be an intermediate component or layer.

It is obvious to those skilled in the art that the present invention is not limited to the details of the above exemplary embodiments, but can be implemented in other specific forms without departing from the spirit or basic features of the present invention. Therefore, the embodiments should be regarded as exemplary and non-limiting in every respect. The scope of the present invention is defined by the appended claims rather than the above description, and therefore all changes that fall within the meaning and range of equivalent elements of the claims are intended to be included in the present invention. Any reference signs in the claims shall not be regarded as limiting the claims involved.

In addition, it should be understood that although this specification is described in terms of embodiments, not every embodiment includes only one independent technical solution. This description of the specification is for the sake of clarity only. Those skilled in the art should take the specification as a whole, and the technical solutions in each embodiment can also be appropriately combined to form other embodiments that can be understood by those skilled in the art.

What is claimed is:

1. A bladeless cooling fan, wherein the bladeless cooling fan comprises:

a fan body, comprising an air inlet;

a water cooling component, which is provided together with the air inlet, wherein the water cooling component cools air that enters the fan body via the air inlet;

a wind wheel component, which is accommodated in the fan body and arranged to generate air flow;

an air outlet component, which is installed on the fan body, wherein the air outlet component is arranged to receive the air flow from the fan body and guide the air flow to be ejected to a set direction;

wherein the wind wheel component comprises a diagonal flow wind wheel and a first volute and a second volute cooperating with each other, the first volute cooperates with the second volute to form a wind wheel cavity accommodating the diagonal flow wind wheel, the first volute is provided with a first volute opening through which the air enters, and the second volute is provided with a second volute opening through which the air flow generated by the diagonal flow wind wheel exits;

wherein the wind wheel component further comprises a third volute cooperated with the second volute to form a deflector cavity, the third volute is provided with a third volute opening through which the air flow exits, a deflector cover is provided in the deflector cavity, and the deflector cover is used to guide the air flow flowing into the deflector cavity through the second volute opening to the third volute opening; and wherein the third volute is symmetrically provided with two of the third volute openings, the deflector cover has a gradually decreasing cross-sectional area in a direction in which the deflector cover extends from the second volute to the third volute, a deflector fin cooperating with an inner wall of the third volute is formed on the deflector cover, and the deflector fin divides the deflector cavity into two parts corresponding to the aforementioned two of the third volute openings.

2. The bladeless cooling fan according to claim 1, wherein the air inlet is provided around the fan body.

3. The bladeless cooling fan according to claim 2, wherein the air inlet comprises an array of holes formed on the fan body; and in a plane direction perpendicular to a central axis of the fan body, a cross-section of the fan body is rectangular, and the air inlet is provided on a side wall on a periphery of the fan body.

4. The bladeless cooling fan according to claim 1, wherein the air outlet component comprises two outlet component air inlets corresponding to the two third volute openings and an air outlet through which the air flow is ejected, wherein the second volute opening has a total area less than or equal to the sum of total areas of the two of the third volute openings;

the sum of the total areas of the two of the third volute openings is equal to the sum of total areas of the two outlet component air inlets; and the sum of the total areas of the two outlet component air inlets is less than or equal to total areas of the air outlet.

5. The bladeless cooling fan according to claim 1, wherein the second volute opening is ring-shaped, a plurality of first deflectors are arranged at intervals radially in the second volute opening, and each of the plurality of the first deflectors extends in a direction away from the first volute, which is substantially the same as a direction of the air flow through the second volute opening.

6. The bladeless cooling fan according to claim 1, wherein the air outlet component comprises an outlet component air inlet corresponding to the third volute opening, the third volute further comprises a deflector part provided at the third volute opening, and the deflector part has an outer profile that gradually changes in a direction of the third volute opening toward the outlet component air inlet, so that at least part of the air flow exiting through the third volute opening is guided to the outlet component air inlet.

7. The bladeless cooling fan according to claim 6, wherein the deflector part has a substantially gradually increasing cross-sectional area in a direction away from the third volute opening, and on a plane perpendicular to a central axis of the third volute, a part of an outer edge of a projection of the deflector part is located in a projection of the third volute opening.

8. The bladeless cooling fan according to claim 1, wherein the air outlet component comprises an air outlet, an outlet component air inlet, and an internal channel that transports the air flow from the outlet component air inlet to the air outlet; in a plane direction perpendicular to a direction in which the air flow of the air outlet component is ejected, the air outlet is generally U-shaped.

9. The bladeless cooling fan according to claim 8, wherein the internal channel comprises:

a first channel part, which corresponds to the outlet component air inlet to receive the air flow entering from the outlet component air inlet;

a second channel part, an end of which defines the air outlet;

a bending channel part, which connects the first channel part and the second channel part; wherein in a plane direction perpendicular to an extending direction of the air outlet, the first channel part and the second channel part are substantially parallel, and the air flow has substantially opposite flow directions in the first channel part and the second channel part.

10. The bladeless cooling fan according to claim 9, wherein a plurality of third deflectors are arranged at intervals in a direction in which the air outlet extends, and a central axis of a hole defined by any two adjacent third deflectors is substantially parallel to the direction in which the air flow of the air outlet component is ejected; an extending length of a third deflector at least partially adjacent to the outlet component air inlet is greater than that of a third deflector remote from the outlet component air inlet.

11. The bladeless cooling fan according to claim 10, wherein the third deflector at least partially adjacent to the outlet component air inlet has a gradually increasing extending length in a direction away from the outlet component air inlet; and the third deflector at least partially adjacent to the outlet component air inlet is in an arc-shaped sheet shape bent toward the outlet component air inlet.

12. The bladeless cooling fan according to claim 9, wherein a heating component and a wind deflector are provided in the internal channel; wherein when the bladeless cooling fan is in a heating state, the heating component is capable of being driven to move from the first channel part to the second channel part, and the wind deflector is capable of being driven to close at least part of the air outlet, so that the air received from the fan body is heated via the heating component and then emitted from the air outlet.

13. The bladeless cooling fan according to claim 1, wherein the air outlet component is connected with a mounting limiting base, the fan body is rotatably connected with a mounting base, and the air outlet component is rotatably connected with the fan body through the matching of the mounting limiting base and the mounting base; wherein a first position sensor is provided on the mounting limiting base, a second position sensor is provided on the mounting base, and the bladeless cooling fan controls the rotation angle of the air outlet component relative to the fan body through detection results of the first position sensor and the second position sensor.

14. The bladeless cooling fan according to claim 13, wherein an annular mounting cover and an annular driven gear assembled on the mounting cover are fixed on the fan body, a ball bearing component is provided between the mounting cover and the driven gear, and the bladeless cooling fan further comprises a driving gear which is capable of being driven and meshed with the driven gear.

* * * * *